US009846000B2

(12) United States Patent
Meguriya

(10) Patent No.: US 9,846,000 B2
(45) Date of Patent: Dec. 19, 2017

(54) HEAT EXCHANGER

(71) Applicant: CALSONIC KANSEI CORPORATION, Saitama-shi, Saitama (JP)

(72) Inventor: Yuichi Meguriya, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 205 days.

(21) Appl. No.: 14/418,814

(22) PCT Filed: Jun. 24, 2013

(86) PCT No.: PCT/JP2013/067247

§ 371 (c)(1),
(2) Date: Jan. 30, 2015

(87) PCT Pub. No.: WO2014/021026

PCT Pub. Date: Feb. 6, 2014

(65) Prior Publication Data

US 2015/0211810 A1 Jul. 30, 2015

(30) Foreign Application Priority Data

Aug. 1, 2012 (JP) ..... 2012-170953

(51) Int. Cl.
*F28F 3/08* (2006.01)
*F28D 9/00* (2006.01)
*F28D 9/02* (2006.01)

(52) U.S. Cl.
CPC ..... *F28F 3/08* (2013.01); *F28D 9/005* (2013.01); *F28D 9/02* (2013.01)

(58) Field of Classification Search
CPC .... F28F 3/08; F28F 3/083; F28F 3/086; F28F 3/10; F28F 2225/00; F28F 2225/04;
(Continued)

(56) References Cited

U.S. PATENT DOCUMENTS 4,815,534 A * 3/1989 Fuerschbach ..... F28D 9/0075 165/166
2010/0243200 A1* 9/2010 Baker, Jr. ..... B60H 1/00342 165/41

(Continued)

FOREIGN PATENT DOCUMENTS

JP S58-148480 10/1983
JP 62-293091 12/1987

(Continued)

*Primary Examiner* — Frantz Jules
*Assistant Examiner* — Schyler S Sanks
(74) *Attorney, Agent, or Firm* — Foley & Lardner LLP

(57) ABSTRACT

A plate (3) having a pair of first communication holes (34) and a pair of second communication holes (35) and a plate (4) having a pair of first communication holes (44) and a pair of second communication holes (45) are alternately laminated to alternately form, between the plates (3) and (4) adjacent to each other, a first coolant flow path (81) and a second coolant flow path (82); a first spacer (5) is interposed around each of the first communication holes (34) and (44) within the first coolant flow path (81); and a second spacer (6) is interposed within the second coolant flow path (82) and at a position corresponding to a periphery of each of the first communication holes (34) and (44).

4 Claims, 11 Drawing Sheets

(58) Field of Classification Search
CPC ..... F28D 1/0308; F28D 1/05308; F28D 1/05358; F28D 9/005; F28D 9/0037
USPC ..... 165/906, 916, 167
See application file for complete search history.

(56) References Cited

U.S. PATENT DOCUMENTS

| | | | | |
|---|---|---|---|---|
| 2011/0232868 | A1* | 9/2011 | Iwasaki | F28D 1/0452 165/104.13 |
| 2012/0325446 | A1* | 12/2012 | Wakamatsu | F28F 3/044 165/167 |

FOREIGN PATENT DOCUMENTS

| | | | | |
|---|---|---|---|---|
| JP | 2001-066078 | | 3/2001 | |
| JP | 2001-099584 | | 4/2001 | |
| JP | 2007-205634 | | 8/2007 | |
| WO | WO 2008/023732 | | 2/2008 | |
| WO | WO 2008023732 | A1 * | 2/2008 | F28D 9/005 |
| WO | WO 2008072730 | A1 * | 6/2008 | F28D 1/0443 |

* cited by examiner

HEAT EXCHANGER

CROSS REFERENCE TO RELATED APPLICATIONS

The present application claims priority to Japanese Patent Application No. 2012-170953 filed in Japan on Aug. 1, 2012, the entire contents of which are incorporated herein by reference.

TECHNICAL FIELD

The present invention relates to a heat exchanger in which a first coolant and a second coolant are made to flow and exchange heat between the first coolant and the second coolant.

BACKGROUND ART

As to a conventional heat exchanger of this type, there is a heat exchanger disclosed in Patent Document 1. As illustrated in FIG. 11 to FIG. 13, this heat exchanger 100 has first plates 101 and second plates 102 alternately laminated therein, and in each of the plates 101 and 102, a pair of first communication holes 103 and a pair of second communication holes 104 are formed, respectively. Each of the plates 101 and 102 has an outer peripheral wall 105 protruding toward the same direction of a laminating direction, and the outer peripheral walls 105 adjacent to each other come into contact with each other. Furthermore, a first coolant flow path 106 and a second coolant flow path 107 are alternately provided between the adjacent plates 101 and 102. Each of the first communication holes 103 is opened and each of the second communication holes 104 is closed, to the first coolant flow path 106, and each of the second communication holes 104 is opened, and each of the first communication holes 103 is closed, to the second coolant flow path 107.

In the configuration described above, a first coolant that flows via a coolant inlet portion 108 flows into the first coolant flow path 106 from one side of the first communication holes 103, passes through the first coolant flow path 106, and then, flows out of the other side of the first communication holes 103 via a coolant outlet portion 109. A second coolant that flows via a cooling-water inlet portion 110 flows into the second coolant flow path 107 from one side of the second communication holes 104, flows through the second coolant flow path 107, and then, flows out of the other side of the second communication holes 104 via a cooling-water outlet portion 111. The first coolant and the second coolant exchange heat via the first plate 101 or the second plate 102 during the process of flowing through each of the first coolant flow path 106 and the second coolant flow path 107.

In the heat exchanger 100 having a laminated form as described above, the first plate 101 and the second plate 102 are fixed through brazing in a state where portions of the first plate 101 and the second plate 102 required to be joined are brought into close contact with each other by applying a load, with a jig or the like during brazing, in the laminating direction of the first plate 101 and the second plate 102. At this time, the load applied in the laminating direction is preferably large because the degree of close contact at the potions required to be joined is increased, as long as the first plate 101 and the second plate 102 are within the range of not being deformed.

Furthermore, portions of the first plate 101 and the second plate 102 where the first communication hole 103 or second communication hole 104 is opened have a weaker strength than that of other portions, and it is necessary to achieve a highly airtight structure by reliably brazing the peripheries of the first communication hole 103 and second communication hole 104, where coolant with higher pressure flows. Specifically, in the case where coolant with higher pressure flows into the first coolant flow path 106, it is necessary to perform brazing so that the first communication hole 103 and the first coolant flow path 106 are shielded in a highly airtight manner.

CITATION LIST

Patent Literature

Patent Literature 1: Japanese Patent Laid-Open Publication No. 2007-205634

SUMMARY OF INVENTION

Technical Problem

However, in the heat exchanger 100 of the conventional example described above, when a load is applied in the laminating direction of the first plate 101 and the second plate 102 at the time of brazing, only the load corresponding to the strength of the portion where the first communication hole 103 and the second communication hole 104 are opened can be applied, namely, only a relatively small load can be applied, and thus it is difficult to sufficiently bring the joined portion into close contact. This leads to a problem in which the periphery of the communication hole 103, where coolant with higher pressure flows, cannot be reliably blazed in a highly airtight manner.

In view of the facts described above, the present invention has been made in order to solve the problem described above, and an object of the present invention is to provide a heat exchanger in which the periphery of the communication hole, where coolant with higher pressure flows, can be reliably brazed in a highly airtight manner.

Solution to Problem

The present invention provides a heat exchanger in which: a first plate having a pair of first communication holes and a pair of second communication holes, and a second plate having a pair of first communication holes and a pair of second communication holes are alternately laminated to alternately form, between the first plate and the second plate adjacent to each other, a first coolant flow path and a second coolant flow path; each of the first communication holes is opened, and each of the second communication holes is closed, to the first coolant flow path; each of the second communication holes is opened, and each of the first communication holes is closed, to the second coolant flow path; the first coolant having a pressure higher than the second coolant flows into the first coolant flow path from one side of the first communication holes, and the first coolant that has passed through the first coolant flow path flows out of the other side of the first communication holes; and the second coolant having a pressure lower than the first coolant flows into the second coolant flow path from one side of the second communication holes, and the second coolant that has passed through the second coolant flow path flows out of the other side of the second communication holes, wherein a first spacer is interposed around each of the first communication holes within the first coolant flow path, and a second spacer is interposed within the second coolant flow path and at a position corresponding to a periphery of each of the first communication holes.

The first spacer preferably allows the first coolant to flow between the first communication hole and the first coolant flow path. The first spacer preferably blocks a flow of the first coolant from positions of the first communication holes toward both ends. The first spacer is preferably interposed also around the second communication hole. It is preferable that an inner fin is disposed within the first coolant flow path, and the first spacer surrounds an outer, periphery of the inner fin. It is preferable that the first plate and the second plate each include an outer peripheral wall protruding toward the same direction of a laminating direction, the outer peripheral wall is provided with a step portion, and the first plate and the second plate located adjacent to each other come into contact with each other at the step portion. It is preferable that, when the first plate and the second plate come into contact with each other, a space is formed between the outer peripheral wall of the first plate and the outer peripheral wall of the second plate.

DESCRIPTION OF EMBODIMENTS

Hereinafter, an embodiment according to the present invention will be described with reference to the drawings.

Embodiment

FIG. 1 to FIG. 9 each illustrate an embodiment according to the present invention.

Figure 2:
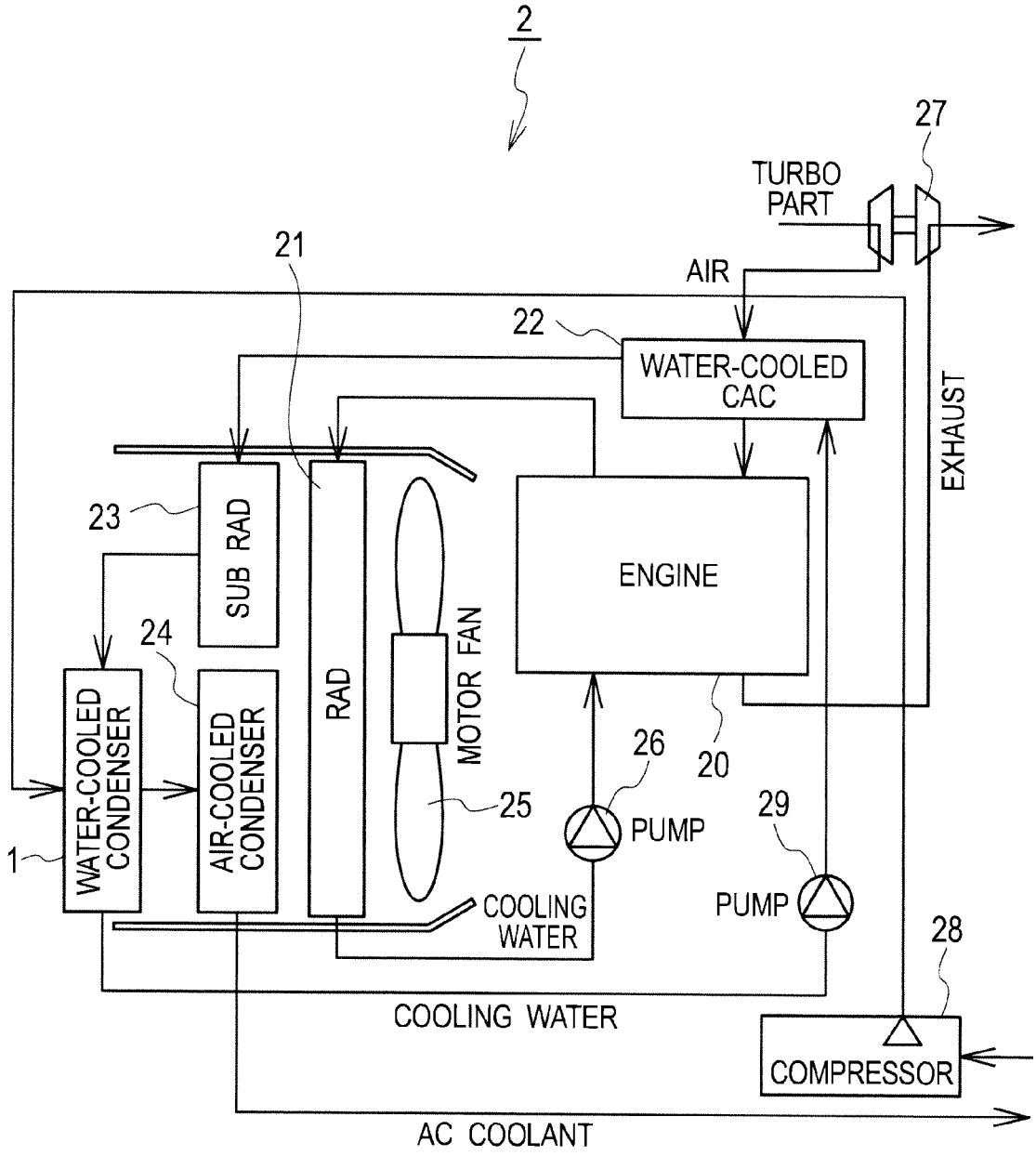
FIG. 2 illustrates an embodiment according to the present invention, and is a configuration view of a vehicle heat-exchanging system to which the heat exchanger is applied.
Figure 3:
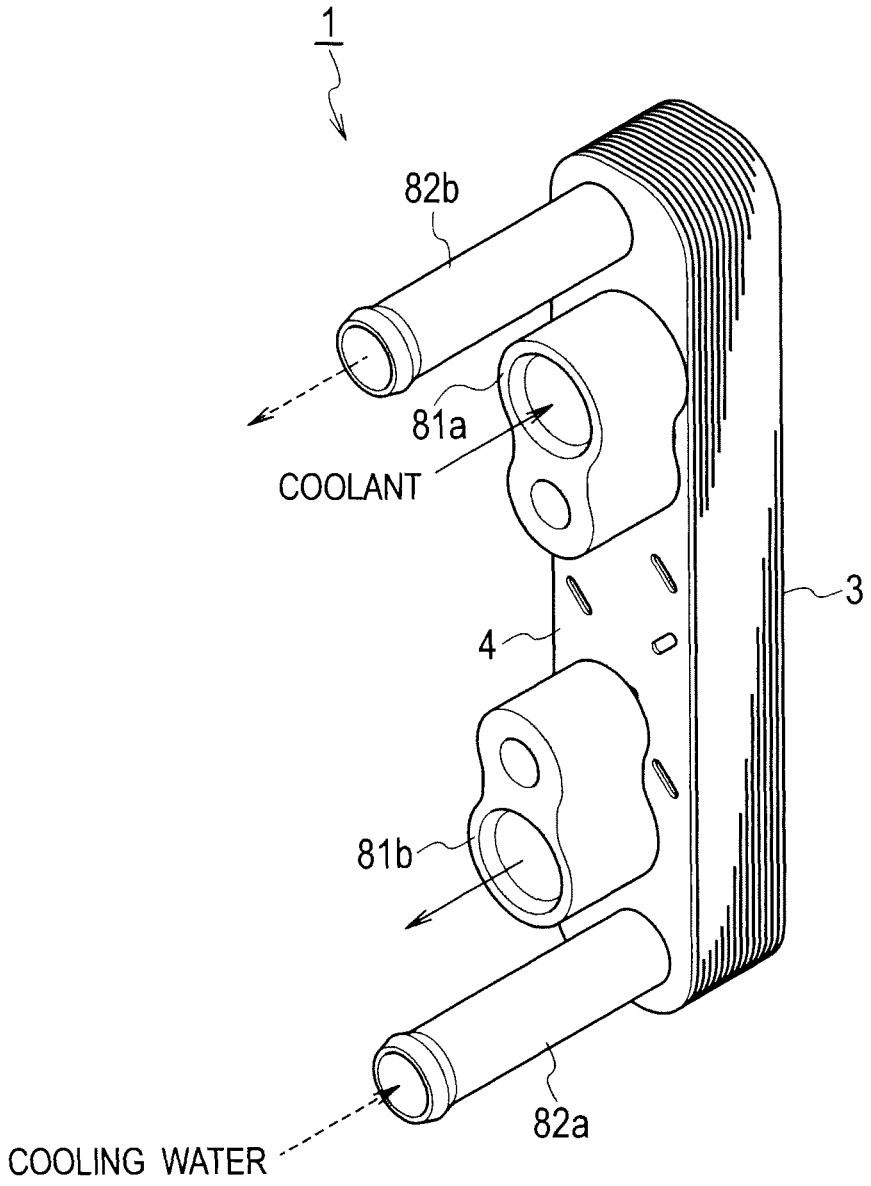
FIG. 3 illustrates an embodiment according to the present invention, and is an entire perspective view of the heat exchanger.
Figure 4:
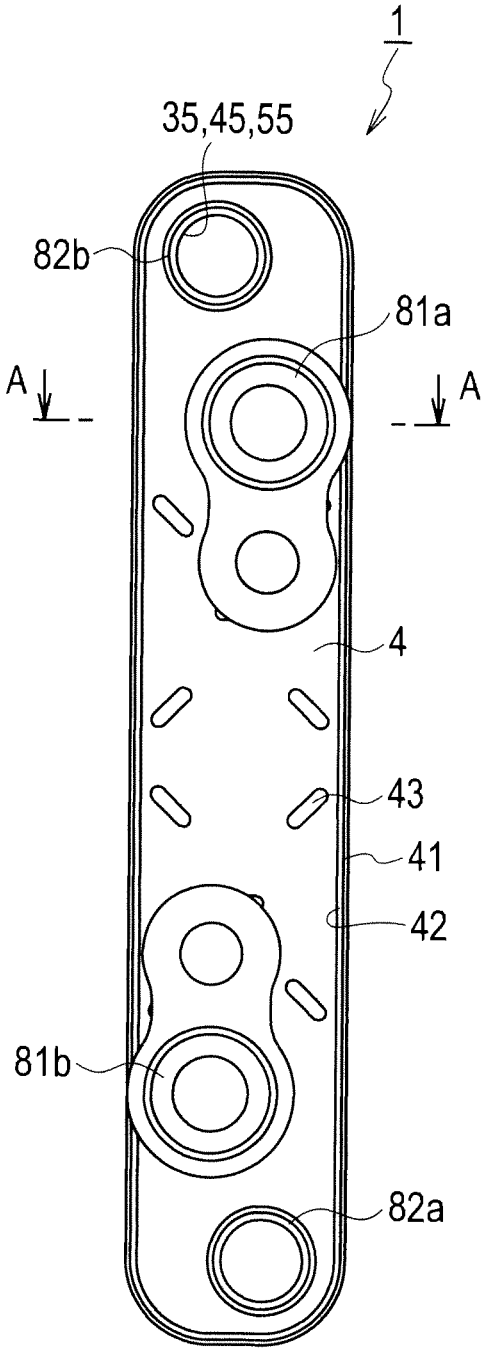
FIG. 4 illustrates an embodiment according to the present invention, and is an elevation view of the heat exchanger.

As illustrated in FIG. 2, a water-cooled condenser 1 (heat exchanger) according to the present embodiment is applied to a vehicle heat-exchanging system 2. This vehicle heat-exchanging system 2 includes the water-cooled condenser 1 according to the present embodiment, a main radiator 21 that cools cooling water for an engine 20, a sub-radiator 23 that cools coolant for a water-cooled charge air cooler 22 (water-cooled CAC), and an air-cooled condenser 24 that cools coolant for an air conditioner for a vehicle interior.

The main radiator 21 is provided on the upstream side of cooling air from a motor fan 25. The main radiator 21 includes plural tubes (not illustrated) in which cooling water for the engine 20 runs, and exchanges heat with cooling air running outside the tubes. The cooling water for the engine is circulated by a pump 26.

The sub-radiator 23 is disposed on the upstream surface side of cooling air from the main radiator 21, and is disposed in an upper-half area. The sub-radiator 23 includes plural tubes (not illustrated) in which cooling water serving as a second coolant for the water-cooled charge air cooler 22 runs, and exchanges heat with cooling air flowing outside the tubes. The cooling water for the water-cooled charge air cooler 22 is circulated by a pump 29. As to air supplied to the engine 20, the temperature of intake air becomes high due to compression with a turbo part 27 through the utilization of exhaust, and thus the compressed high-temperature air is cooled with the water-cooled charge air cooler 22. With this arrangement, it is possible to enhance the density of air supplied to the engine 20 by cooling the intake air, and thereby it is possible to enhance combustion efficiency of the engine 20. Namely, the water-cooled charge air cooler 22 exchanges heat between the compressed intake air supplied to the engine 20 and cooling water, and thus the intake air to the engine 20 is cooled.

The air-cooled condenser 24 is disposed on the upstream surface side of cooling air from the main radiator 21 and in a lower-half area. The air-cooled condenser 24 includes plural tubes (not illustrated) in which an air-conditioning coolant serving as a first coolant runs, and exchanges heat with cooling air running outside the tubes.

Next, the water-cooled condenser 1 according to the present embodiment will be described. As illustrated in FIG. 2, the water-cooled condenser 1 and the air-cooled condenser 24 are connected in series within a refrigeration cycle with the water-cooled condenser 1 being located on the upstream side. The air-conditioning coolant being subjected to high temperature and high pressure by a compressor 28 in the refrigeration cycle and serving as the first coolant, first flows into the water-cooled condenser 1, and then, flows out to the air-cooled condenser 24. The cooling water being subjected to cooling by the sub-radiator 23 and serving as the second coolant, flows into the water-cooled condenser 1 to thereby exchange heat with the air-conditioning coolant, and then, flows into the water-cooled charge air cooler 22.

Figure 1:
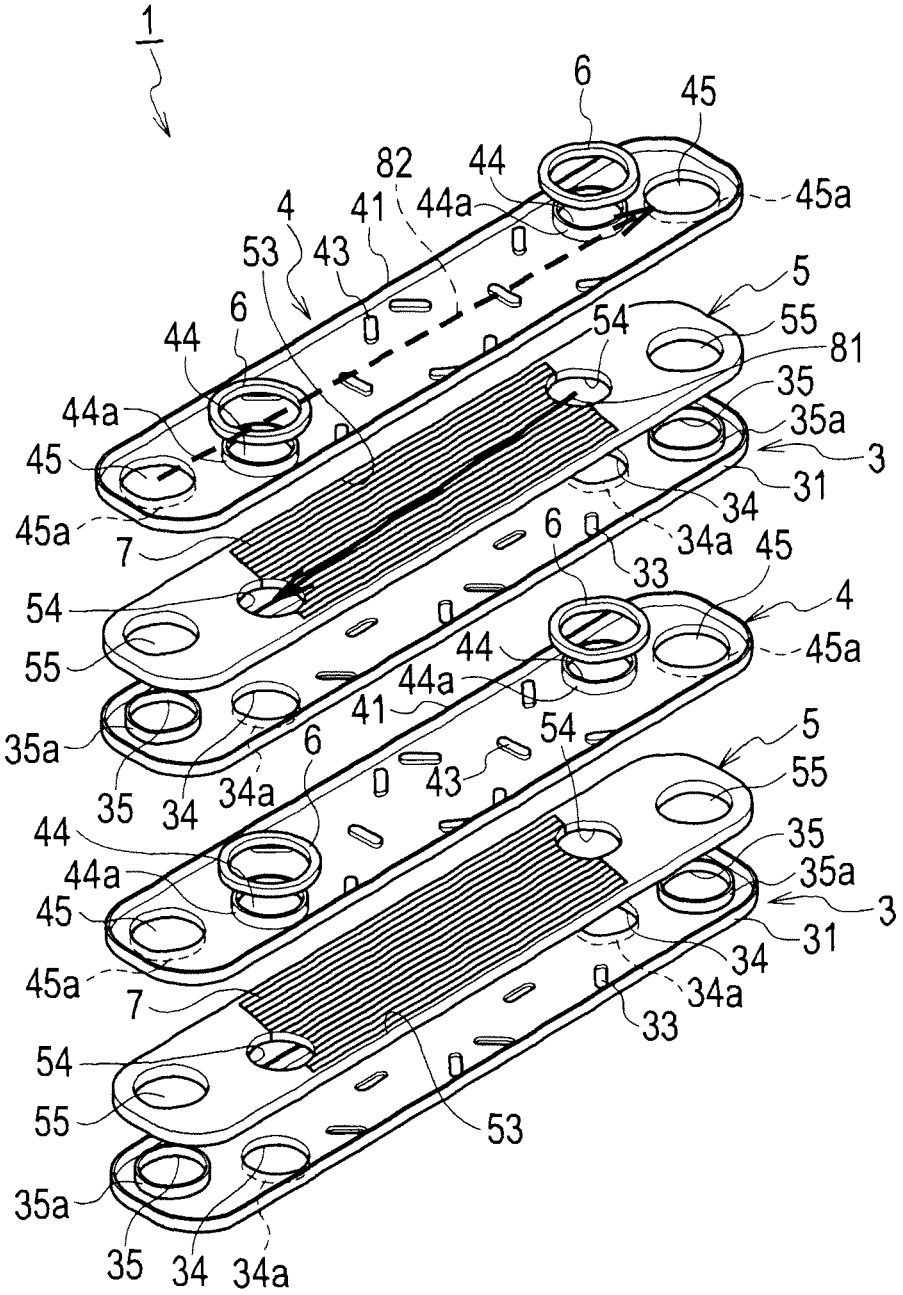
FIG. 1 illustrates an embodiment according to the present invention, and is a partially exploded perspective view of a heat exchanger.
Figure 5:
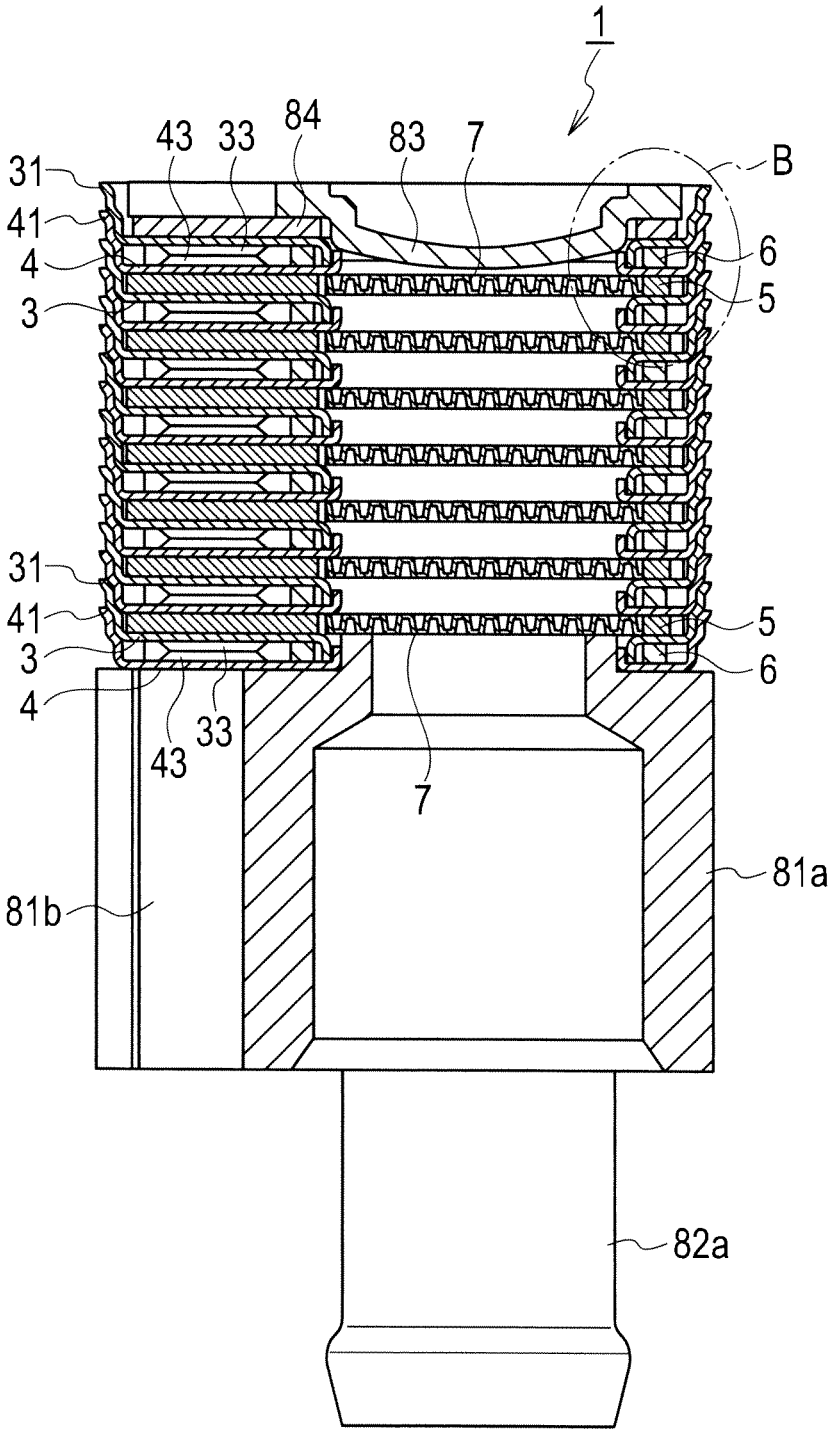
FIG. 5 illustrates an embodiment according to the present invention, and is a transverse cross-sectional view taken along line A-A in FIG. 4.

As illustrated in FIG. 1, FIG. 5 and the like, the water-cooled condenser 1 according to the present embodiment includes: first plates 3 and second plates 4, which are alternately laminated; first spacers 5 and second spacers 6, which are alternately interposed between each of the first plates 3 and each of the second plates 4; and inner fins 7 each having the outer periphery surrounded by each of the first spacers 5. All of the contact surfaces between these parts are fixed through brazing.

Figure 6:
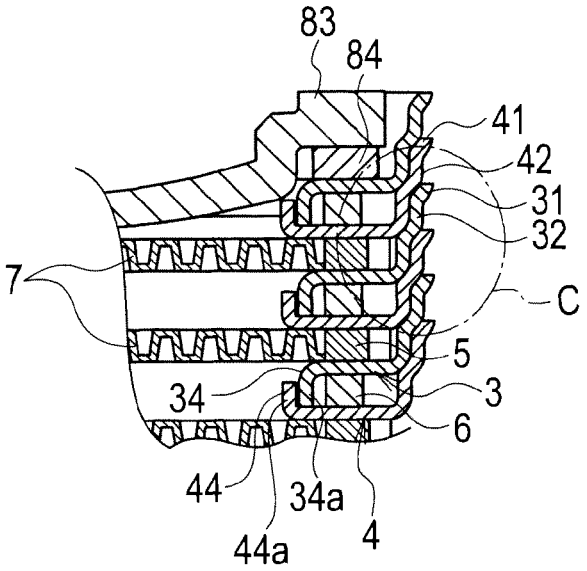
FIG. 6 illustrates an embodiment according to the present invention, and is a transverse cross-sectional view in which portion B in FIG. 5 is enlarged.
Figure 7:
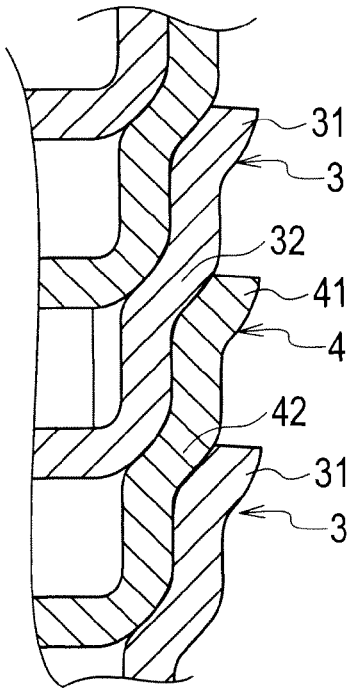
FIG. 7 illustrates an embodiment according to the present invention, and is a transverse cross-sectional view in which portion C in FIG. 6 is further enlarged.
Figure 8:
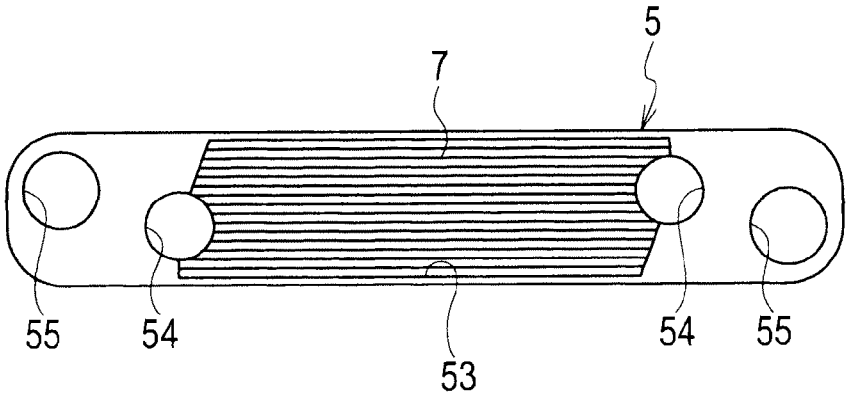
FIG. 8 illustrates an embodiment according to the present invention, and is a plan view of a first spacer and an inner fin.
Figure 9:
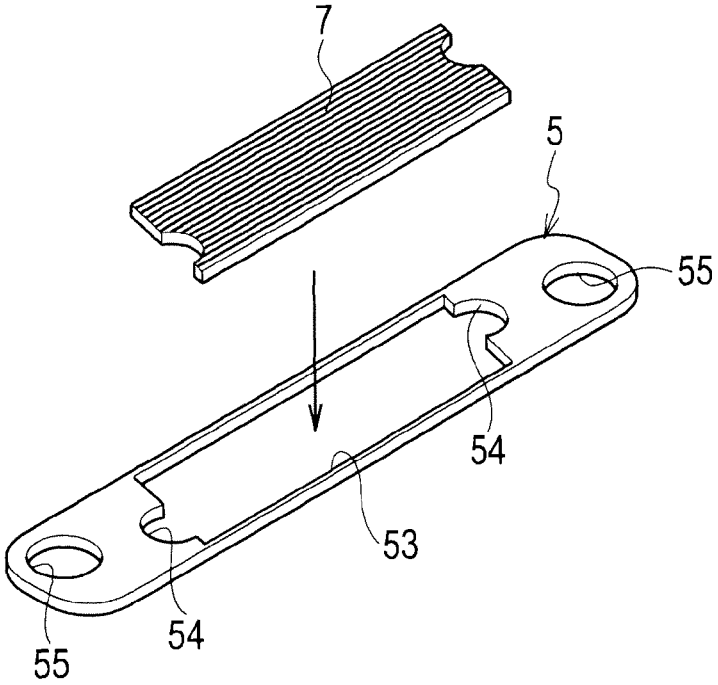
FIG. 9 illustrates an embodiment according to the present invention, and is an exploded perspective view of the first spacer and the inner fin.

As illustrated in FIG. 5 to FIG. 7, the first plates 3 and the second plates 4 have, respectively, outer peripheral walls 31 and 41, which protrude toward the same direction of the laminating direction, and the outer peripheral walls 31 and 41 are, respectively, provided with step portions 32 and 42. At the step portions 32 and 42, the first plate 3 and the second plate 4 located adjacent to each other come into contact with each other. Each of the plates 3 and 4 is provided with plural protrusions 33 and 43 each protruding on the side of a second coolant flow path 82 to be described later, and having top ends coming into contact with each other, and the contacting surfaces of these protrusions 33 and 43 are brazed to each other.

When the first plate 3 and the second plate 4, located adjacent to each other, come into contact with each other, a space is formed between the outer peripheral wall 31 of the first plate 3 and the outer peripheral wall 41 of the second plate 4. A brazing filler metal is accumulated in the space at the time of brazing.

The first plate 3 includes a pair of first communication holes 34 through which the air-conditioning coolant flows, and a pair of second communication holes 35 through which the cooling water flows. Furthermore, the second plate 4 includes a pair of first communication holes 44 through which the air-conditioning coolant flows, and a pair of second communication holes 45 through which the cooling water flows. Between the first plate 3 and the second plate 4 located adjacent to each other in a state of being alternately laminated, a first coolant flow path 81 into which the air-conditioning coolant flows as indicated by the arrow with a solid line in FIG. 1 and the second coolant flow path 82 into which the cooling water flows as indicated by the arrow with a broken line in FIG. 1 are alternately provided.

Annular-shaped protruding edge portions 34*a* and 44*a* around the first communication holes 34 and 44 of the first plate 3 and the second plate 4 protrude into the second coolant flow path 82, and are brazed and joined to each other in a state of overlapping with each other within this second coolant flow path 82. In the same way, annular-shaped protruding edge portions 35*a* and 45*a* around the second communication holes 35 and 45 protrude into the first coolant flow path 81, and are brazed and joined to each other in a state of overlapping with each other within this first coolant flow path 81.

With the configuration described above, each of the first communication holes 34 and 44 is opened, and each of the second communication holes 35 and 45 is closed, to the first coolant flow path 81. Furthermore, the air-conditioning coolant having a pressure higher than the cooling water flows into each first coolant flow path 81 from one side of the first communication holes 34 and 44, and the air-conditioning coolant having flowed through each first coolant flow path 81 flows out of the other side of the first communication holes 34 and 44. In contrast, each of the second communication holes 35 and 45 is opened, and each of the first communication holes 34 and 44 is closed, for the second coolant flow path 82. Furthermore, the cooling water having a pressure lower than the air-conditioning coolant flows into each second coolant flow path 82 from one side of the second communication holes 35 and 45, and the cooling water having flowed through each second coolant flow path 82 flows out of the other side of the second communication holes 35 and 45.

At one end (lower end in FIG. 5) of the first plates 3 and the second plates 4 in the laminating direction, there are protrusively provided, respectively, a coolant inlet portion 81*a* and a coolant outlet portion 81*b* through which the air-conditioning coolant flows into or flows out, and a cooling-water inlet portion 82*a* and a cooling-water outlet portion 82*b* through which the cooling water flows into or flows out. At the other end (upper end in FIG. 5) of the first plates 3 and the second plates 4 in the laminating direction, there are provided a patch end 83 and a flange portion 84 that close each of the end portions of the pair of first communication holes 34 and 44 and a pair of second communication holes 55.

The inner fin 7 is disposed within the first coolant flow path 81. The contact surface of the inner fin 7 and each of the plates 3 and 4 is also brazed.

The first spacer 5 is disposed within the first coolant flow path 81. The first spacer 5 includes a fin-accommodating opening portion 53 that accommodates the inner fin 7, a pair of first communication holes 54 provided at positions corresponding to the pair of first communication holes 34 and 44 of each of the plates 3 and 4, and the pair of second communication holes 55 provided at positions corresponding to the pair of second communication holes 35 and 45 of each of the plates 3 and 4. The first spacer 5 is disposed so as to surround the entire periphery of the inner fin 7. Each of the first communication holes 54 is opened to the fin-accommodating opening portion 53. With this arrangement, it becomes possible for the air-conditioning coolant to flow into or out of the first coolant flow path 81, and the air-conditioning coolant does not flow from the position of each of the first communication holes 34 and 44 toward both ends. Each of the second communication holes 55 has a diameter larger than that of each of the protruding edge portions 35*a* and 45*a* around each of the second communication holes 35 and 45 of each of the plates 3 and 4. With this arrangement, the first spacer 5 is disposed so as to surround the protruding edge portions 35*a* and 45*a* of the second communication holes 35 and 45.

The second spacer 6 is disposed within the second coolant flow path 82. As illustrated in FIG. 1, the second spacer 6 has an annular shape. The second spacer 6 is provided at a position corresponding to the periphery of the pair of first communication holes 34 and 44 of each of the plates 3 and 4. The second spacer 6 has an internal diameter larger than each of the protruding edge portions 34*a* and 44*a* around the first communication holes 34 and 44 of the plates 3 and 4. With this arrangement, each of the second spacers 6 is disposed so as to surround the protruding edge portion 34*a* and 44*a* of the first communication holes 34 and 44.

In the configuration described above, the air-conditioning coolant made into a state of gas having a high temperature and high pressure through the compressor 28 in the refrigeration cycle, first flows into the water-cooled condenser 1, and flows into one side of the first communication holes 34, 44, and 54 of the water-cooled condenser 1 via the coolant inlet portion 81*a*. Then, the air-conditioning coolant passes through the first coolant flow path 81 between the first plate 3 and the second plate 4, and flows out to the air-cooled condenser 24 from the other side of the first communication holes 34, 44, and 54 via the coolant outlet portion 81*b*.

On the other hand, the cooling water cooled by the sub-radiator 23 flows into the second communication holes 35, 45, and 55 of the water-cooled condenser 1 via the cooling-water inlet portion 82*a*. Then, the cooling water passes through the second coolant flow path 82 between the first plate 3 and the second plate 4, flows out of the other side of the second communication holes 35, 45, and 55 via the cooling-water outlet portion 82*b*, and flows into the water-cooled charge air cooler 22 via the pump 29. With this arrangement, the air-conditioning coolant and the cooling water exchange heat via the first plate 3 or the second plate 4 during processes of passing through each of the first coolant flow path 81 and the second coolant flow path 82 of the water-cooled condenser 1.

Next, manufacturing of the water-cooled condenser 1 will be briefly described. A brazing filler material is basically applied to a portion of each of the parts coming into contact with each other, and each of the parts having the brazing filler material applied thereto is set as a predetermined position, and is disposed in a laminated state. The brazing filler material joined portions are sufficiently brought into close contact with each other by applying a relatively large load in the laminating direction of the plates 3 and 4, with a jig or the like.

Here, the first spacer 5 or the second spacer 6 is interposed between the plates 3 and 4 throughout the entire laminating direction. Specifically, the first spacer 5 is interposed around each of the first communication holes 34 and 44 within the first coolant flow path 81, and the second spacer 6 is interposed within the second coolant flow path 82 and at a position corresponding to the periphery of each of the first communication holes 34 and 44, whereby it is possible to reinforce portions of the plates 3 and 4 where the first communication holes 34 and 44 are opened. Therefore, even if large force is applied in the laminating direction of the plates 3 and 4, it is possible to prevent buckling of the periphery of each of the first communication holes 34 and 44 of the plates 3 and 4. Furthermore, since the first spacer 5 is interposed around each of the second communication holes 35 and 45 of the plates 3 and 4, it is possible to reinforce portions of the plates 3 and 4 where each of the second communication holes 35 and 45 is opened.

With these configurations as described above, at the time of laminating the plates 3 and 4 to thereby braze them, it is possible to sufficiently bring the joined portions into close contact with each other by applying relatively a large load in the laminating direction of the plates 3 and 4, and thus the peripheries of the first communication holes 34 and 44 and the first coolant flow path 81, where coolant with high pressure flows, can be reliably brazed in a highly airtight manner.

Furthermore, permissible ranges of a load applied in the laminating direction of the plates 3 and 4 at the time of brazing are widened, and thus manufacturing of the water-cooled condenser 1 is easy.

The first spacer 5 allows the air-conditioning coolant to flow between the first communication holes 34 and 44 of the plates 3 and 4 and the first coolant flow path 81, and does not prevent the air-conditioning coolant from flowing into or out of the first coolant flow path 81. Therefore, the air-conditioning coolant smoothly flows within the first coolant flow path 81.

The flow of the air-conditioning coolant going from the positions of the first communication holes 34 and 44 toward both ends is blocked at end surfaces of the first communication holes 54 and the fin-accommodating opening portion 53 of the first spacer 5. Therefore, it is possible to prevent the air-conditioning coolant from staying in the vicinity of both ends of the first coolant flow path 81, and thus it is possible to prevent the reduction in efficiency of heat exchange.

The heat transfer area of the first coolant flow path 81 in which the air-conditioning coolant flows is increased through the use of the inner fin 7, and thus it is possible to more effectively enhance efficiency of heat exchange of the air-conditioning coolant. Furthermore, by appropriately setting the height of the inner fin 7 and the thickness of the first spacer 5 surrounding the outer periphery of this inner fin 7, it is possible to prevent buckling of the inner fin 7 due to a load acting in the laminating direction at the time of brazing, and thus, by applying a sufficient load in the laminating direction of the plates 3 and 4, it is possible to bring the inner fins 7 and the plates 3 and 4 into close contact with each other, and to reliably perform brazing. Alternatively, by reducing the thickness of each of the plates 3 and 4 according to the degree of enhancement in the strength of the inner fin 7 against the load described above, it is also possible to reduce the weight.

The first plate 3 and the second plate 4 located adjacent to each other come into contact with each other at the step portions 32 and 42 provided at the outer peripheral wall 31 on the outer periphery of the first plate 3 and the outer peripheral wall 41 provided on the outer periphery of the second plate 4, respectively. The relative positional relationship between the first plate 3 and the second plate 4 is fixed by the contact at the step portion 32 and 42, when relatively a large load is applied in the laminating direction of the plates 3 and 4. Therefore, it is possible to appropriately keep a fitting margin (overlapping length of outer peripheral walls) between the first plate 3 and the second plate 4 to be laminated, and thus accuracy of assembly of the plates 3 and 4 is enhanced. Furthermore, since the space for accumulating the brazing filler metal is formed between the outer peripheral walls 31 and 41 of the plates 3 and 4, it is possible to enhance a brazing property.

Meanwhile, through the use of a three-layered member having the brazing filler material on both sides for the first spacer 5 and the second spacer 6 each having a relatively large thickness, it is possible to resolve a shortage of the brazing filler material, particularly on the coolant side on which strong pressure resistance is required.

(Modification)

Figure 10:
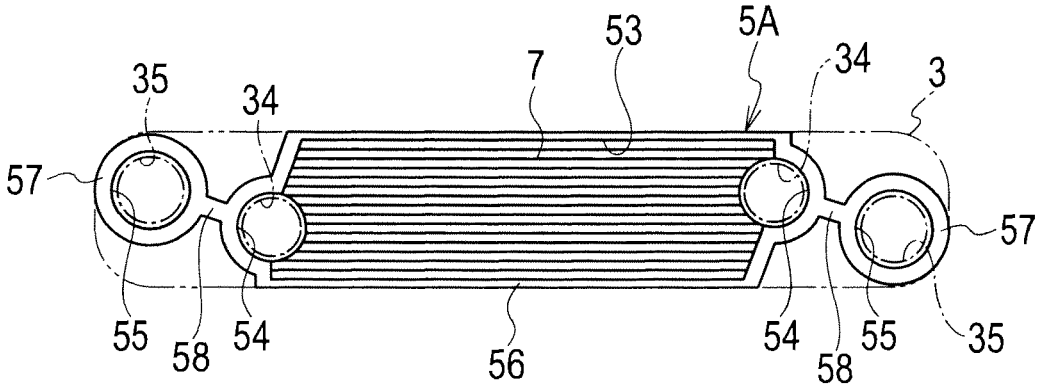
FIG. 10 is a plan view of a first spacer and an inner fin according to a modification of an embodiment.
Figure 11:
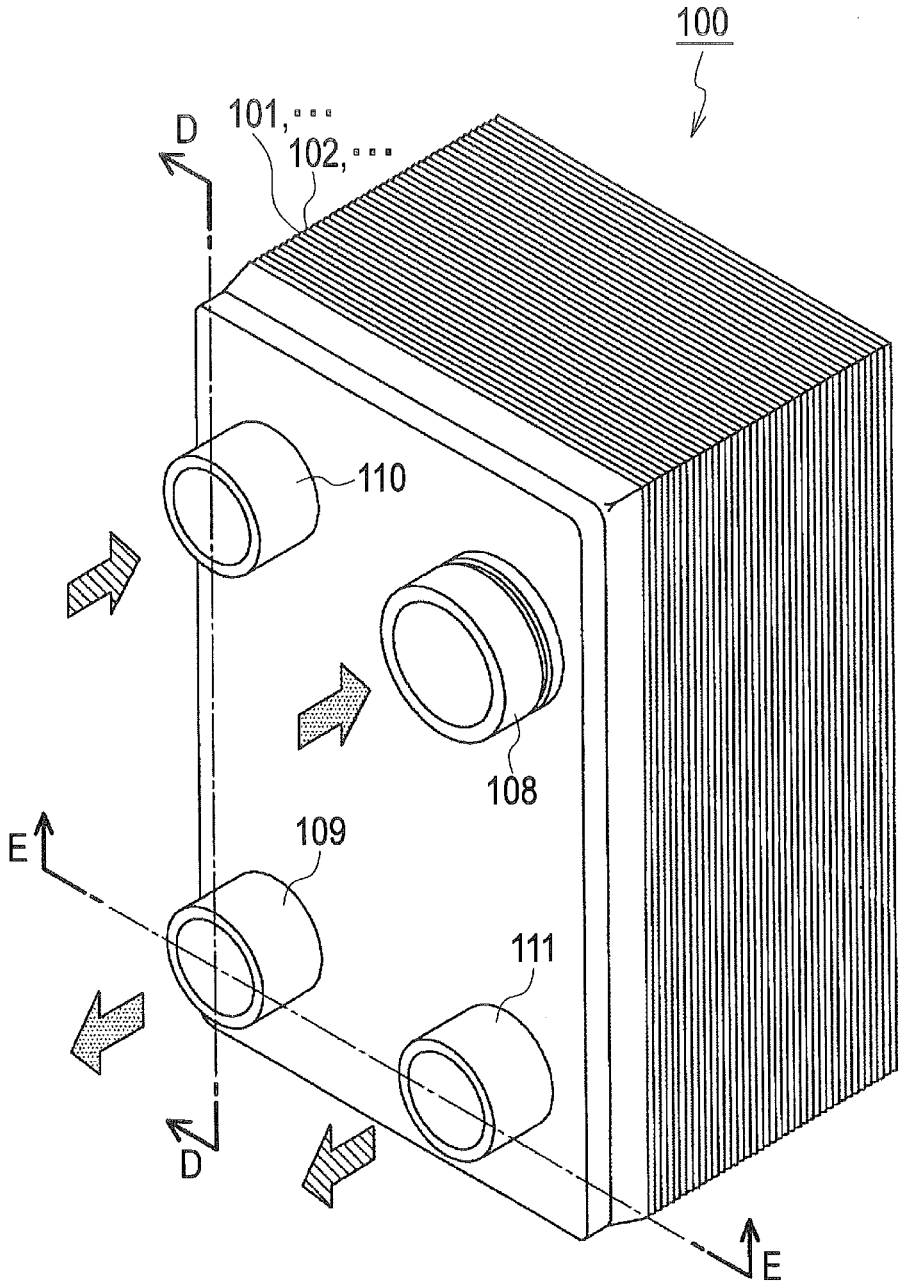
FIG. 11 PRIOR ART
FIG. 11 is an entire perspective view of a conventional example of a heat exchanger.
Figure 12:
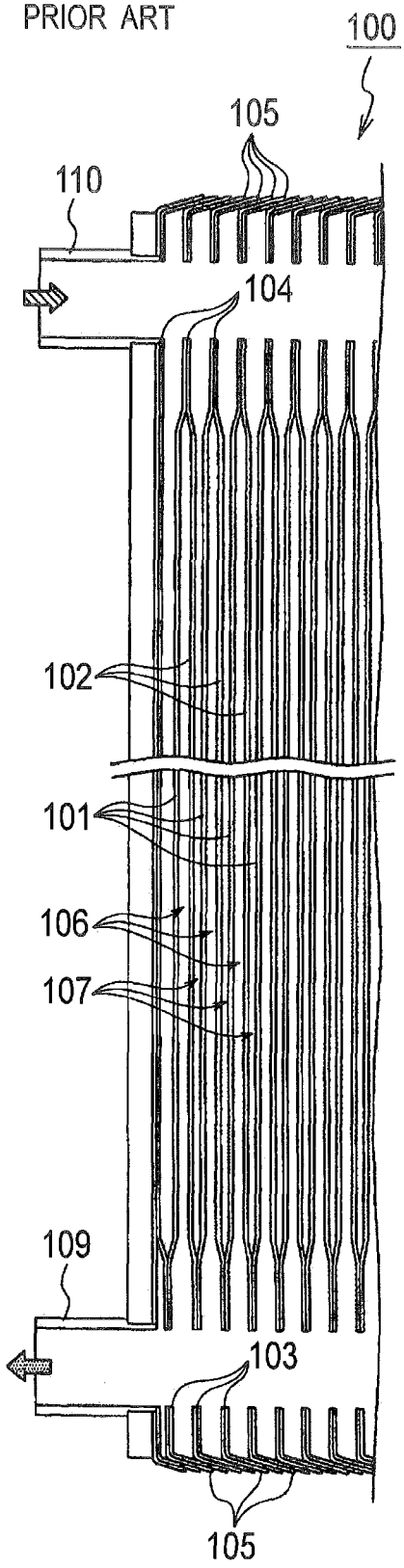
FIG. 12 PRIOR ART
FIG. 12 is a cross-sectional view taken along line D-D in FIG. 11.
Figure 13:
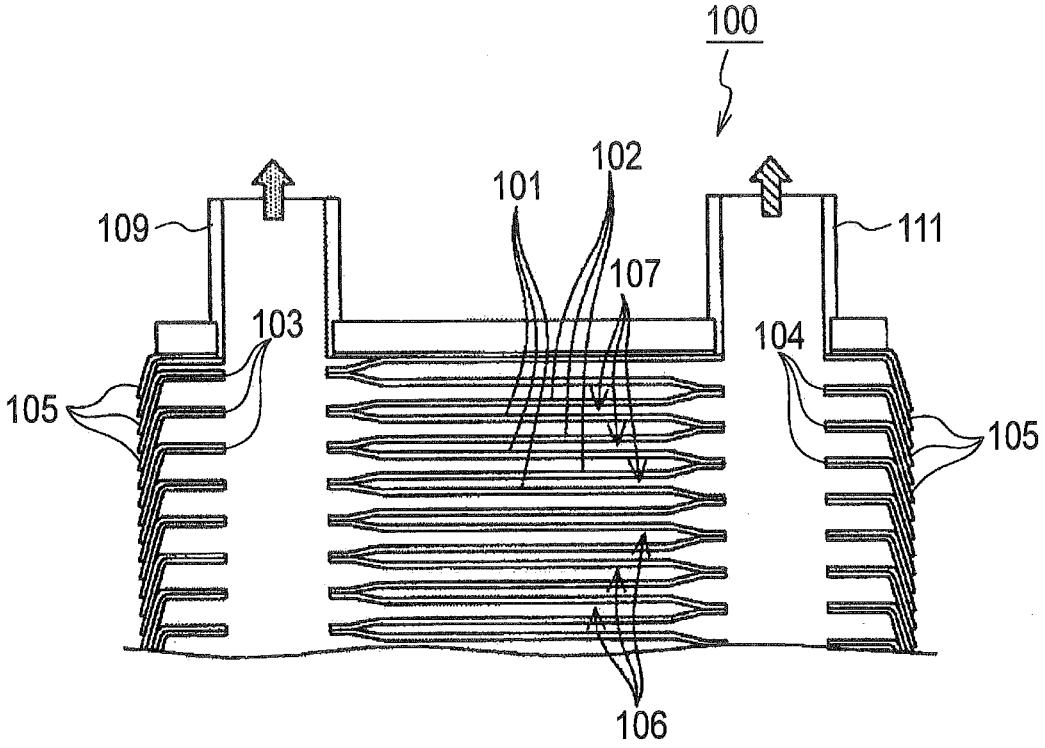
FIG. 13 PRIOR ART
FIG. 13 is a cross-sectional view taken along line E-E in FIG. 11.

FIG. 10 illustrates a first spacer 5A and an inner fin 7 according to a modification of the embodiment described above. As illustrated in FIG. 10, the first spacer 5A according to the modification includes: a frame body 56 that surrounds the inner fin 7; a pair of annular portions 57 each linked to the frame body 56 and surrounding the entire periphery of each of the second communication holes 55; and linking portions 58 that link the frame body 56 with the pair of annular portions 57. Within the frame body 56, a pair of first communication holes 54 is provided, and the flow of the first coolant going from the positions of the first communication holes 34 and 44 toward both ends is blocked by the frame body 56.

Configurations other than those described above are the same as those in the above-described embodiment, and thus explanation thereof will be omitted in order to avoid repeated explanation. Furthermore, in the drawing, the same reference signs are attached to the configuration portions same as those in the above-described embodiment in order to make clarification.

Through the use of the first spacer 5A according to this modification, it is possible to reduce the weight as compared with the spacer in the above-described embodiment. Moreover, the frame body 56 and the pair of annular portions 57 are structured to be linked with the narrow linking portion 58, and thus it is possible to improve a yield of materials.

INDUSTRIAL APPLICABILITY

According to the present invention, the first spacer is interposed around each of the first communication holes in the first coolant flow path in which high-pressured coolant flows and the second spacer is interposed within the second coolant flow path and at the position corresponding to the periphery of each of the first communication holes, whereby it is possible to reinforce the portions of the first plate and the second plate where each of the first communication holes is opened. Therefore, in the case where a load acts in the laminating direction of the plates, it is possible to prevent the buckling of the periphery of each of the first communication holes of the first plate and the second plate. This makes it possible to sufficiently bring the joined portions into close contact with each other by applying relatively a large load in the laminating direction of the plates, at the time of laminating the plates to thereby braze them, and thus the peripheries of the first communication holes and the first coolant flow path, where coolant with high pressure flows, can be reliably brazed in a highly airtight manner.

REFERENCE SIGNS LIST

1 water-cooled condenser (heat exchanger)
3 first plate
4 second plate
5, 5A first spacer
6 second spacer
7 inner fin
31, 41 outer peripheral wall
32, 42 step portion
34, 44 first communication hole
35, 45 second communication hole
81 first coolant flow path
82 second coolant flow path

The invention claimed is:

1. A heat exchanger, comprising:

a first plate having
- a pair of first-plate-side first communication holes;
- a pair of first-plate-side second communication holes;
- a pair of first-plate-side first protrusions, each of which surrounds a respective hole of the first-plate-side first communication holes; and
- a pair of first-plate-side second protrusions, each of which surrounds a respective hole of the first-plate-side second communication holes;

a second plate having
- a pair of second-plate-side first communication holes;
- a pair of second-plate-side second communication holes;
- a pair of second-plate-side first protrusions, each of which surrounds a respective hole of the second-plate-side first communication holes; and
- a pair of second-plate-side second protrusions, each of which surrounds a respective hole of the second-plate-side second communication holes;

a first spacer interposed between the first plate and the second plate; and a second spacer interposed between the first plate and the second plate, wherein
- the first plate and the second plate are alternately laminated to alternately form, between the first plate and the second plate, a first coolant flow path in which a first coolant flows and a second coolant flow path in which a second coolant flows, the first plate and the second plate being adjacent to each other;
- each of the pair of first-plate-side first protrusions overlaps with a respective protrusion of the pair of second-plate-side first protrusions within the second coolant flow path to form a first overlapped portion, such that the pair of first-plate-side first communication holes and the pair of second-plate-side first communication holes are opened to the first coolant flow path and are closed to the second coolant flow path;
- each of the pair of first-plate-side second protrusions overlaps with a respective protrusion of the pair of second-plate-side second protrusions within the first coolant flow path to form a second overlapped portion, such that the pair of first-plate-side second communication holes and the pair of second-plate-side second communication holes are closed to the first coolant flow path and are opened to the second coolant flow path;
- the first coolant has a higher pressure than the second coolant;
- the first coolant flow path is structured such that the first coolant flows into the first coolant flow path from one of the pair of first-plate-side first communication holes and one of the pair of second-plate-side first communication holes, and such that the first coolant which has passed through the first coolant flow path flows out of the other of the pair of first-plate-side first communication holes and the other of the pair of second-plate-side first communication holes;
- the second coolant flow path is structured such that the second coolant having a lower pressure than the first coolant flows into the second coolant flow path from one of the pair of first-plate-side second communication holes and one of the pair of second-plate-side second communication holes, and such that the second coolant which has passed through the second coolant flow path flows out of the other of the pair of first-plate-side second communication holes and the other of the pair of second-plate-side second communication holes;
- the first spacer is located around the first-plate-side first communication holes and the second-plate-side first communication holes, and the first spacer is located within the first coolant flow path,
- the second spacer is located around the first overlapped portion, and the second spacer is located within the second coolant flow path and reinforces the first overlapped portion to prevent buckling of the first overlapped portion, and
- the first spacer is located around the second overlapped portion within the first coolant flow path and reinforces the second overlapped portion to prevent buckling of the second overlapped portion.

2. The heat exchanger according to claim 1, wherein the first spacer is structured to permit the first coolant to flow from the one of the pair of first-plate-side first communication holes and the one of the pair of second-plate-side first communication holes to the other of the pair of first-plate-side first communication holes and the other of the pair of second-plate-side first communication holes along the first coolant flow path.

3. The heat exchanger according to claim 1, wherein an inner fin is disposed within the first coolant flow path, and the first spacer surrounds an outer periphery of the inner fin.

4. The heat exchanger according to claim 1, wherein the first plate and the second plate each include an outer peripheral wall protruding toward the same direction of a laminating direction, and the outer peripheral wall is provided with a step portion, wherein the first plate and the second plate are located adjacent to each other and come into contact with each other at the step portion.

* * * * *